US005937613A

United States Patent [19]

Vess, Sr.

[11] Patent Number: 5,937,613

[45] Date of Patent: Aug. 17, 1999

[54] UPRIGHT STUD POSITIONING SLIDE

[76] Inventor: Michael Gene Vess, Sr., 31606 East St. Rd. 44, Eustis, Fla. 32736

[21] Appl. No.: 08/827,800

[22] Filed: Apr. 11, 1997

[51] Int. Cl.[6] ..... E04G 21/18; B25H 7/04

[52] U.S. Cl. ..... 52/749.1; 52/295; 52/DIG. 1; 33/42; 33/613; 33/666

[58] Field of Search ..... 52/749.1, 749.14, 52/DIG. 1, 293.3, 295; 33/42, 481, 464, 660, 613, 666, 679, 406, 407; 248/245, 265, 297.21, 298.1

[56] References Cited

U.S. PATENT DOCUMENTS

| | | | |
|---|---|---|---|
| 2,645,194 | 7/1953 | Underwood | 33/613 X |
| 3,397,458 | 8/1968 | Wicklund | 33/413 X |
| 3,730,469 | 5/1973 | Shields | 248/265 |
| 4,060,905 | 12/1977 | Light | 33/613 |
| 4,520,571 | 6/1985 | Harding | 33/666 |
| 4,552,193 | 11/1985 | Armas | 33/562 X |
| 4,574,492 | 3/1986 | Miller | 33/481 X |
| 4,993,168 | 2/1991 | Acuna | 33/574 X |
| 5,390,422 | 2/1995 | Hill | 33/412 X |
| 5,402,584 | 4/1995 | Kessler | 33/810 X |
| 5,456,015 | 10/1995 | Butcher et al. | 33/481 X |

*Primary Examiner*—Carl D. Friedman
*Assistant Examiner*—Winnie S. Yid
*Attorney, Agent, or Firm*—Charles E. Lykes, Jr. Esq.

[57] ABSTRACT

The present invention comprises a means of marking the placement of holes to be drilled within a foundational sill in a more accurate and time-effective manner. The apparatus includes a pre-measured sliding placement member which further comprises a slot cut to the precise width of a foundational sill to be positioned.

1 Claim, 5 Drawing Sheets

UPRIGHT STUD POSITIONING SLIDE

FIELD OF THE INVENTION

The invention relates to measuring devices particularly those which are uniquely adapted to the construction field. Reference is made to United States Patent Office Disclosure Document No. 408898, filed by the Inventor on Nov. 7, 1996.

BACKGROUND OF THE INVENTION

Subsequent to the laying of a building foundation, one of the critical construction tasks is the positioning of a sill or foundation member about the periphery of the building location. Frequently these sill members are wooden and of standard sizes. The foundation will normally be adapted with a series of upright fastening members. These upright fastening members (such as lag bolts) will be about the periphery and will not be precisely measured but will be within the desired sill width. The task then is to drill holes in the sill members which will precisely receive the upright fastening members.

The construction worker is then confronted with the task of making precise measurements of the distance that each of these upright members is from the edge of the foundation and then making a similar measurement onto the desired sill in order to drill the hole at the precise location in the desired sill. Since there will be several uprights receiving holes along the length of a given sill, these measurements are very critical. If any one of them is more than slightly off, a sill member could be wasted. Sill members are normally strong, thick, and expensive. Waste of them is particularly undesirable.

Additionally, the act of having to make precise measurements in two different places (from upright to foundation edge and from sill edge to hole) is also a time consuming effort. It would be advantageous to both reduce the amount of time required for this task as well as to improve on the accuracy of the measurement.

Relating to the application of building components or substructure to foundations, the contracting industry has from time to time developed special purpose tools to deal with specific contingencies. For example, in U.S. Pat. No. 4,580,926, issued to Bunnell, on Apr. 8, 1986, a foundation level and orientation tool was developed for use with underground oil wells in order to assist in leveling the foundation of a sub-sea structure. Additionally, in U.S. Pat. No. 5,177,917, issued to Haucke, on Jan. 12, 1993, the inventor developed a vertical building construction section which enabled standard dimension lumber and plywood sheets that is both faster and avoided "stick" construction.

As critical as the task seems, the Inventor is aware of no previous apparatus or method which have been developed in order to assist in positioning the sill member of a building to its foundation.

What would be helpful then would be an apparatus and method of making such measurements quickly, efficiently, and in a very accurate manner so as to save time and the expense of material costs.

SUMMARY OF THE INVENTION

The Inventor has solved the problems inherent in the above related art by developing a slotted slide tool which assists in making these measurements. By positioning the sill along the edge of the foundation and aligning the tool with the outward edge of the sill, the sliding slot can be used to both locate the position of the upright and mark onto the sill where the desired hole needs to be drilled.

It is then an object of the present invention to provide a more effective means of positioning holes in sills to receive the uprights from a building foundation.

It is a further object of the present invention to provide a sliding tool which is capable of assisting in the construction task of positioning upright receiving holes in building foundation members or sills.

It is a further object of the present invention to provide such a measuring device which may be quickly and accurately used with a given sill.

It is a further object of the present invention to provide such an upright positioning tool which may be used with sills of more than one width.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

Figure 1:
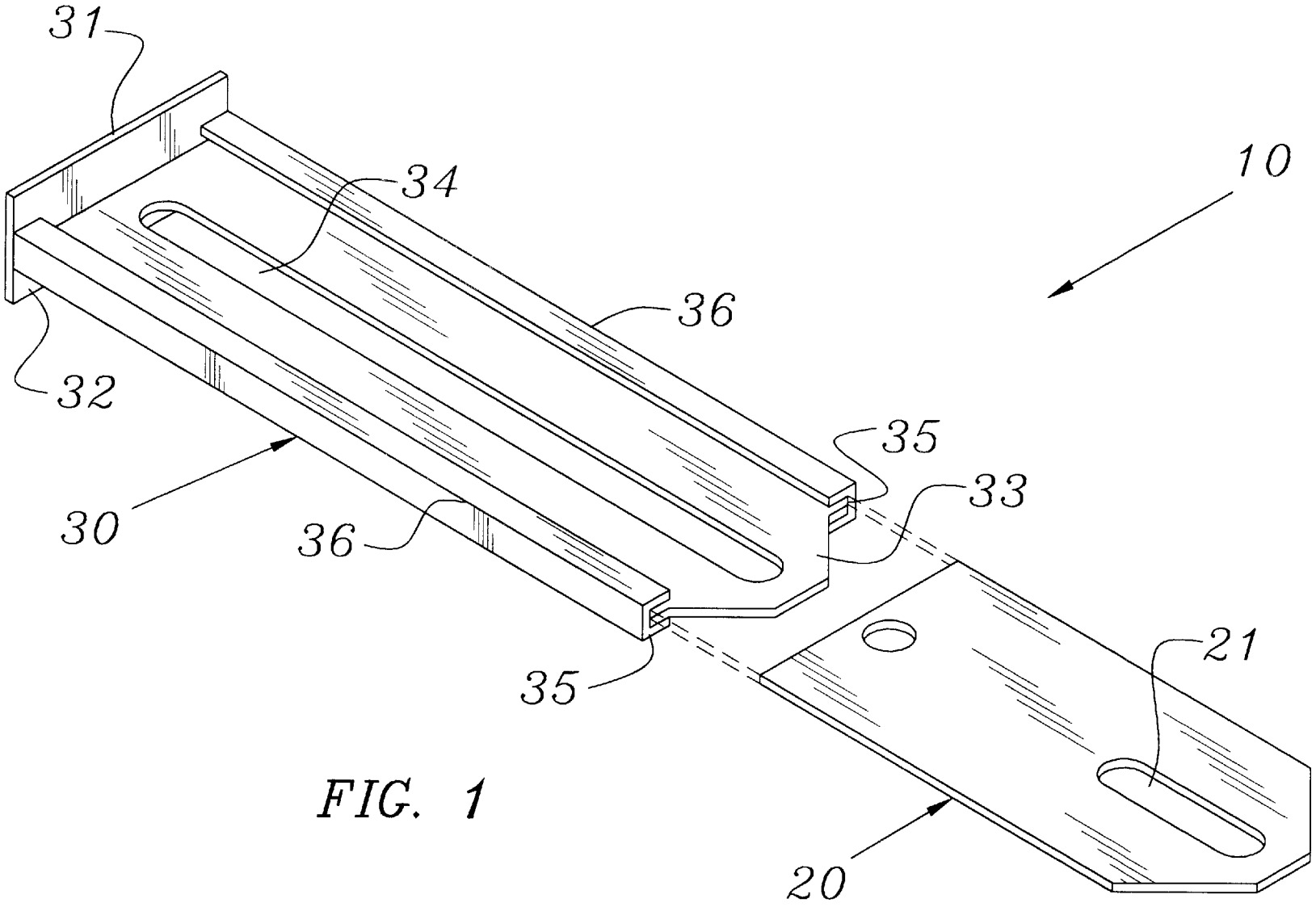
FIG. 1 is an oblique view of the present invention demonstrating each of the parts in their functional relationship.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Making reference first to FIG. 1, the principal components of the sliding positioning tool (10) can be seen. A sliding member (20) is adapted with an elongated slot (21) through the length of its midsection. The length (22) of the slot corresponds precisely with the width of a sill (not depicted in FIG. 1) which is to be placed upon a foundation (not depicted in FIG. 1). The width (23) of the slot (21) is adapted to receive an upright member, such as a lag bolt (also not depicted in FIG. 1).

Figure 2:
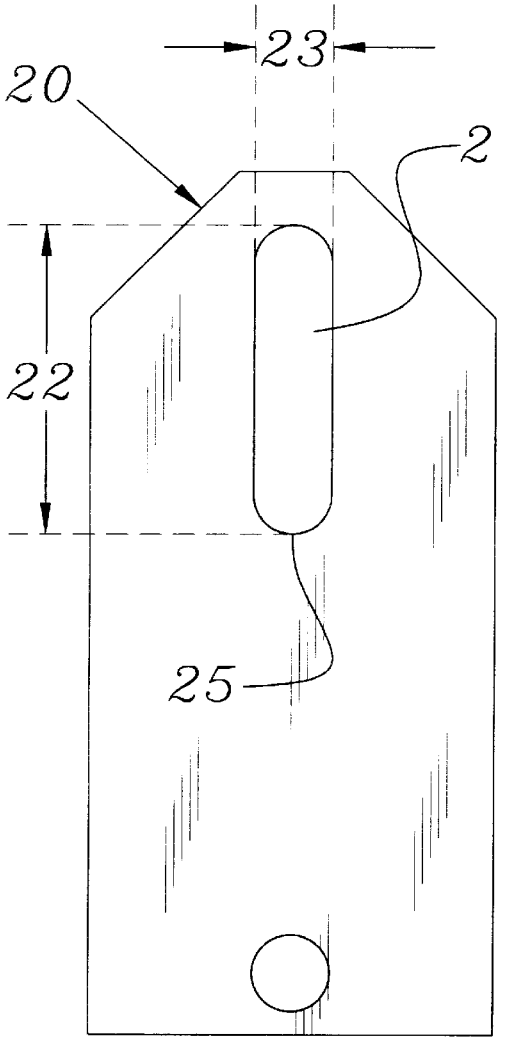
FIG. 2 is an isolated view of a sliding slotted member.

The ends (25) of the slot (21) may be arced so as to aid in centering or otherwise positioning the outline of a lag bolt (not depicted in FIG. 1). FIG. 2 depicts this sliding member (20) in isolation, still without the sill, foundation, and upright members which will be shown and described later.

Figure 3:
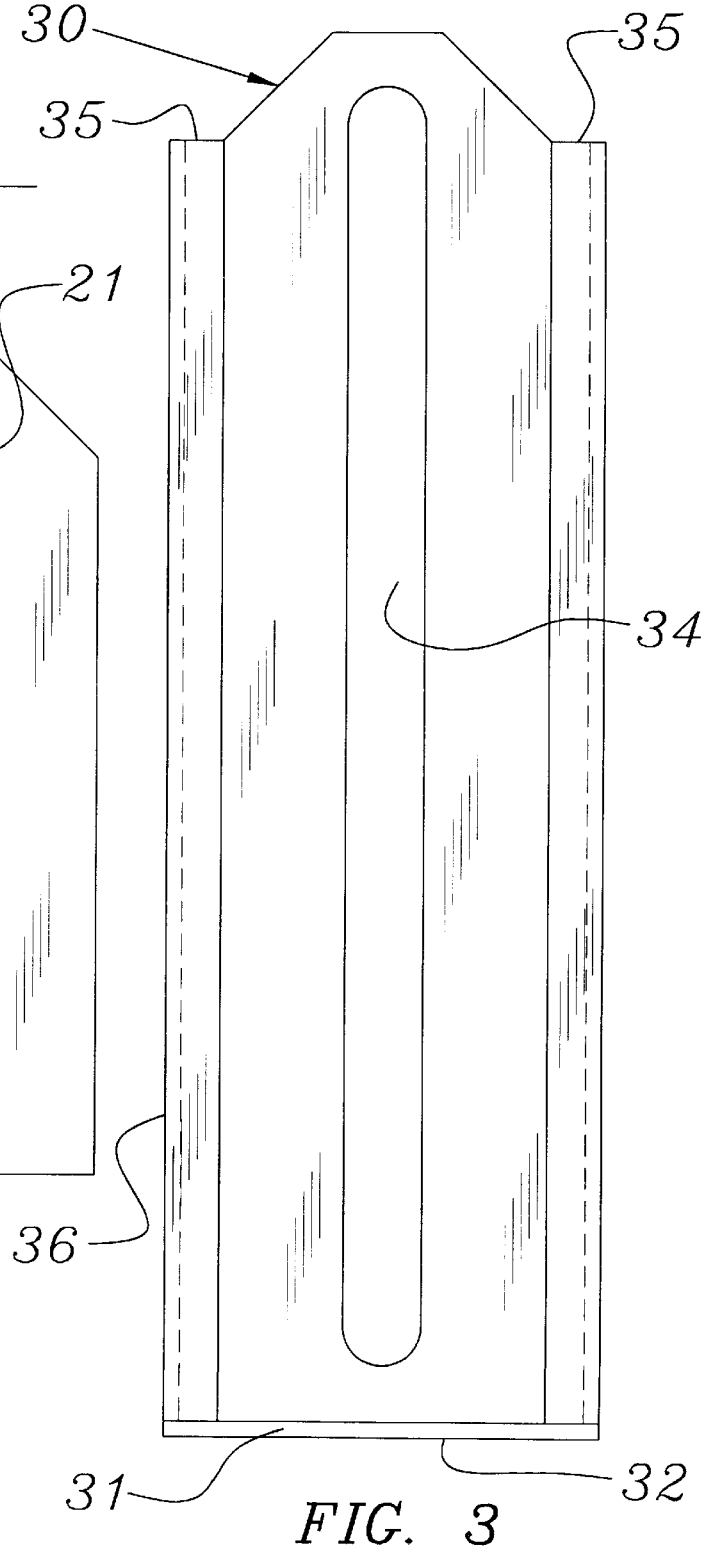
FIG. 3 depicts the receiving member with the slots for receiving the sliding member.

Also depicted in FIGS. 1 and 3 are the slide receiving member (30). The slide receiving member (30) is adapted with a back side (31) which is further adapted with a positioning plate (32) whose plane is perpendicular with the length of a slide receiving plate (33). The slide receiving plate (33) is also adapted with an elongated slot (34) which will be of equal width and will, along its length, slide along the position of the sliding member slot (21). In other words, it is also of sufficient width to receive an upright sill stabilizing member (not depicted in FIGS. 1, 2, or 3). When the sliding member slot (21) is positioned above or below the slide receiving slot (34), together they form a single slot, as will be more clearly seen in FIG. 5.

The slide receiving plate (33) is also adapted with slide receiving channels (35) along its sides (36). Such slots (21, 34) allow the sliding member (20) to be snugly received within the channels (35) and to remain in stable lengthwise position with the slide receiving member (32) as the sliding member (20) is slid back and forth along the slide receiving plate (32). In this manner it can be seen that the slots (21, 34) together form a single open slot. The slide receiving member is positioned in isolation in FIG. 3.

Figure 4:
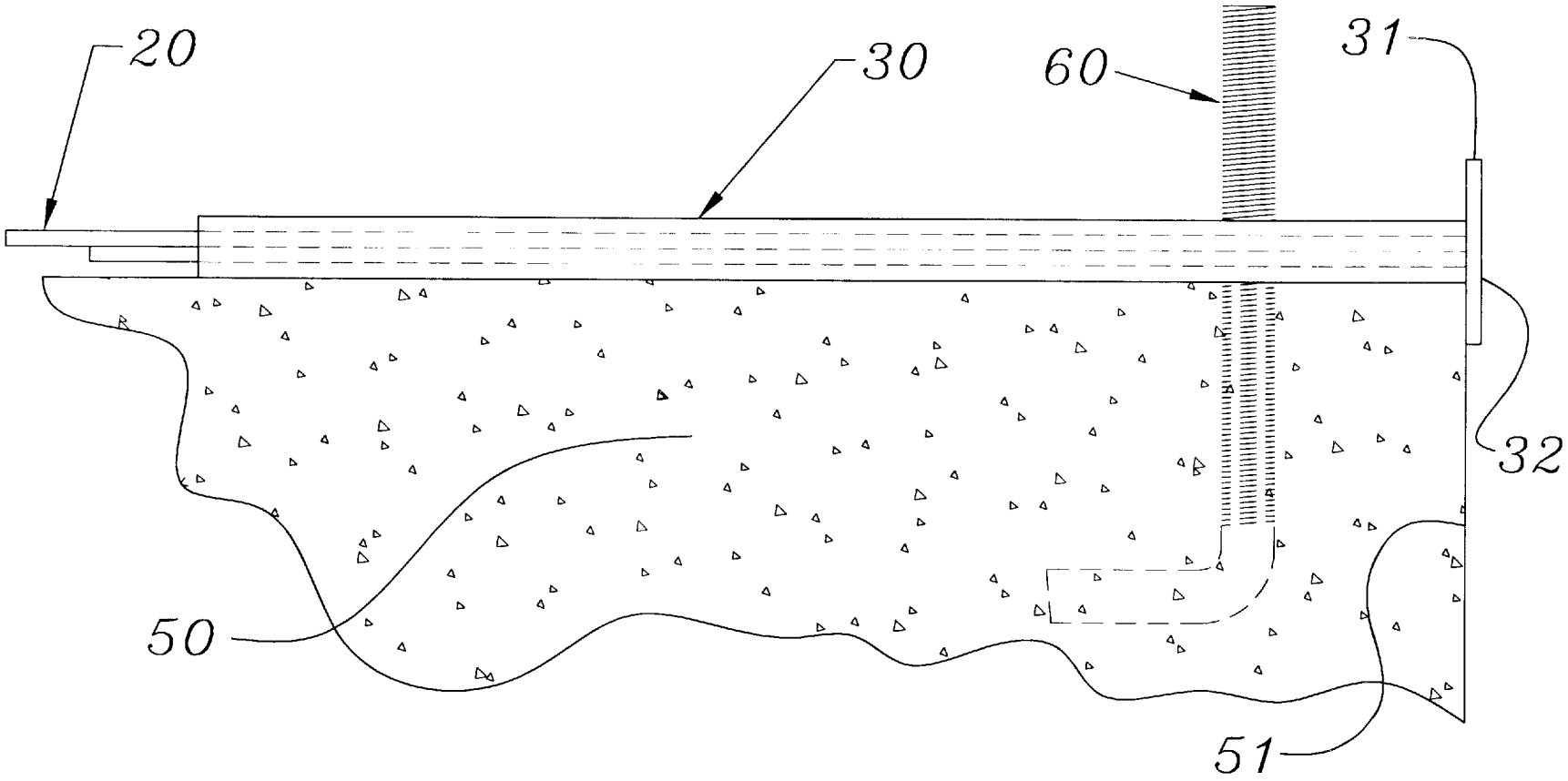
FIG. 4 depicts a side view of the apparatus as positioned to measure an upright member.

FIG. 4 is a side view of the apparatus as positioned along a sill and over an upright lag bolt (60). It can be seen that the perpendicular positioning plate (31) rests firmly against the outer edge (41) of a sill (40) which is positioned along the outer edge (51) of the building foundation (50). It can also be seen that when positioned for use, the upright fastening member (such as a lag bolt (60)) protrudes up through the described slots (21, 34) to the measuring device (10).

Figure 5:
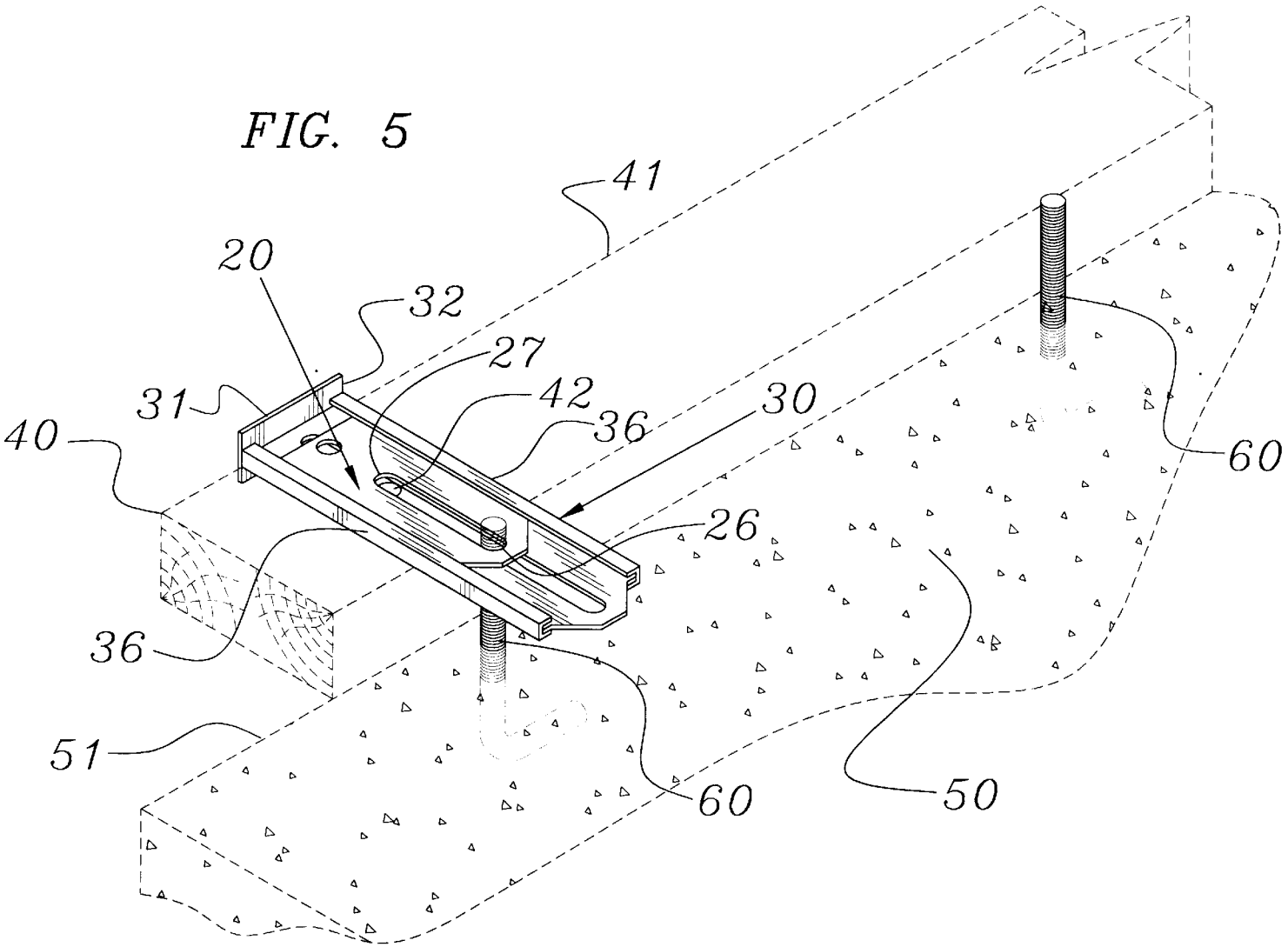
FIG. 5 depicts a top view of the apparatus as positioned to measure an upright member.

Making reference to FIG. 5, it can be seen that the sliding slot (21) can be slid to a point where its outer end (26) makes contact with an upright foundation member, such as a lag bolt (60). The inner end (27) of the sliding slot will now be positioned over the sill member (40) at a point which is precisely where a hole (42) will need to be drilled to receive the upright member (60) when it is placed into position over the foundation (50) edge with the foundation edge (51) aligned with the sill edge (41). FIGS. 4 and 5 depict side and top views of this process.

As presently described, it is necessary to have a different tool for each potential sill width. This is because the sliding slot is made of a length to precisely correspond with one such sill width. Making reference to FIG. 6, however, it is shown that it is possible, however, to provide a sliding slot (71) which is marked with two or perhaps three different locations (72, 73, 74) in order to correspond with various sill widths (such as 4", 6", and 8"). In this case the construction task requires an informed decision to be made by the workman, namely to ensure that the sill is marked according to the correct sill width mark on the sliding slot. This does offer the advantage, however, of allowing a single tool to be used for a construction job which may involve sills of varying widths.

Additionally, there may be other specific structures or combinations of slide members and slide receiving members which will accomplish the task of positioning a sliding slot and a stationary slot one on top of the other. For instance, it is possible that the sliding slot could be below the stationary slide receiving slot.

Additionally, the two could be positioned together by means other than the edge receiving slots depicted in the present invention. For instance, elongated slots could be positioned on either side of the positioning slot which could be used to keep the sliding member and the slide receiving member precisely aligned as the sliding member is slid against the slide receiving member. Theoretically, the invention could be successfully practiced with no mechanism which would physically hold the two members against one another and a construction worker could successfully practice the invention by simply manually positioning the sliding slot precisely above the slide receiving slot. This would, however, clearly be a more cumbersome and less efficient and effective way to accomplish the task. It is worth noting, however, because it demonstrates that the particular means and manner of positioning the two against one another is not crucial to the practice of the invention.

Figure 6A:
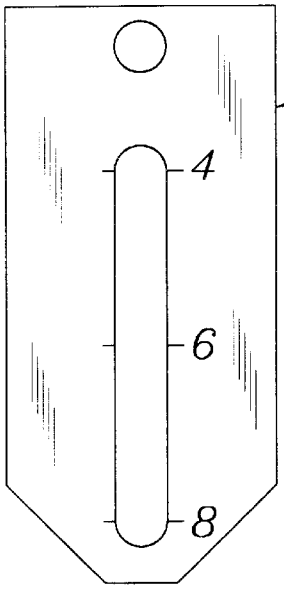
FIGS. 6A, 6B, and 6C depict alternative sliding structures.
Figure 6B:
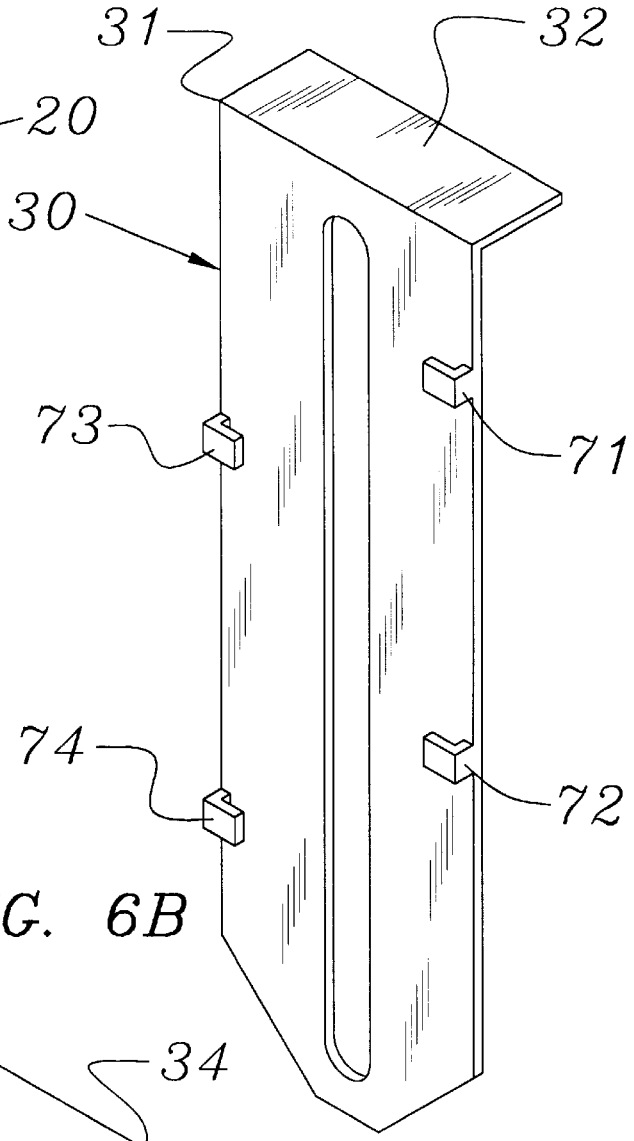
Figure 6C:
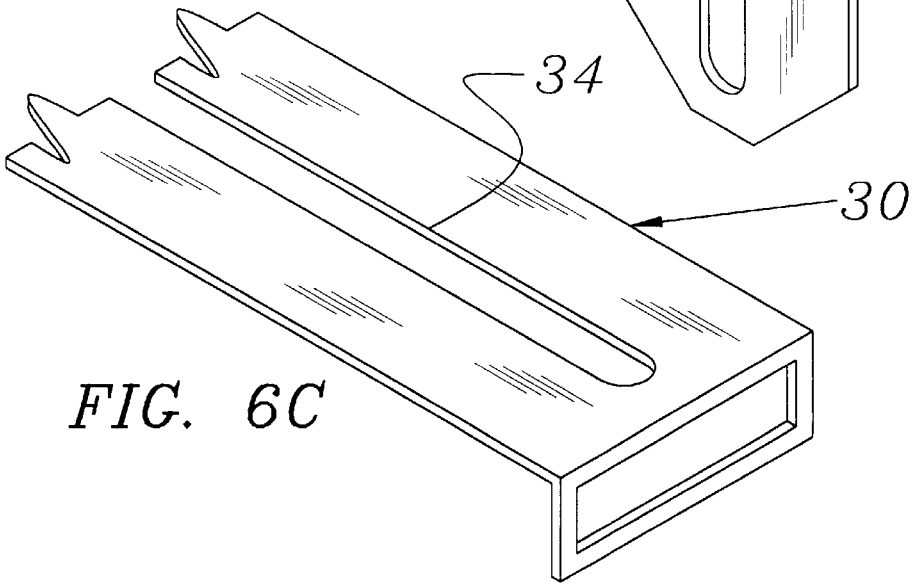

In addition to the exposed sliding channel described and depicted above, for instance, a base member could be adapted with an enclosed planar cavity through which a sliding member could be completely contained and slid back and forth therethrough. Additionally, instead of channel which runs the entire length of the base member, the base member could be adapted with three or four retaining members along its length, so long as the number and strength of such retaining members was sufficient to snugly hold the sliding member in relative position with the base member. It is not the purpose and focus of this invention to teach other means of holding planar members in relative sliding position, but rather to teach the process of expediting the measuring and positioning of upright receiving holes in foundational sill members. FIGS. 6A, 6B, and 6C depict these alternative forms.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. A method for positioning a hole on a sill member to receive an upright fastening member from a building foundation, the method comprising the steps of:

providing a measuring apparatus including a slotted measuring plate and a sliding plate, said slotted measuring plate having a vertical base plate and an elongated slotted slide channel, said sliding plate being received within said elongated slotted slide channel and having a slot which is precisely measured to correspond with a width of the sill member to be positioned along a foundation edge and which slides back and forth along a length of said measuring plate and said sliding plate slot will slide back and forth along said measuring plate slot so that said measuring plate slot and said sliding plat slot define a common open slot;

positioning said slotted measuring plate over said upright fastening member so that said upright fastening member will protrude through said common open slot and further to maintain a stable position from an edge of said building foundation to said upright fastener;

sliding said sliding plate slot along the slot in said slotted measuring plate and engaging an inner end of said sliding plate slot with said upright fastener so as to measure and fix the precise distance from said foundation edge to said upright fastening member; and placing said measuring apparatus, so adjusted, over said sill member and placing said vertical base plate to engage an outer edge of the sill member, and then marking the position for the placement of an upright fastener receiving hole on the sill member through said sliding plate slot.

* * * * *